US005408926A

United States Patent [19]

Alder

[11] Patent Number: 5,408,926

[45] Date of Patent: Apr. 25, 1995

[54] PAD TRANSFER PRINTING DOCTOR BLADE AND METHOD

[76] Inventor: Robert A. Alder, 440 E. Heinberg St., Pensacola, Fla. 32501

[21] Appl. No.: 196,433

[22] Filed: Feb. 15, 1994

[51] Int. Cl.[6] ..... B41M 1/10

[52] U.S. Cl. ..... 101/170; 101/169

[58] Field of Search ..... 101/155, 157, 163–169, 101/120, 124, 123, 154, 170

[56] References Cited

U.S. PATENT DOCUMENTS

| | | | |
|---|---|---|---|
| 3,978,817 | 9/1976 | Hauser et al. | 118/637 |
| 4,070,964 | 1/1978 | Veregaal | 101/120 |
| 4,085,672 | 4/1978 | Grosart | 101/169 |
| 4,151,797 | 5/1979 | Dunsirn | 101/169 |
| 4,184,429 | 1/1980 | Widmer | 101/169 |
| 4,466,348 | 8/1984 | Buhrer | 101/163 |
| 5,222,433 | 6/1993 | Philipp | 101/163 |

*Primary Examiner*—Edgar S. Burr
*Assistant Examiner*—Christopher A. Bennet

[57] ABSTRACT

In a pad transfer printing process a doctor blade is in the form of a downwardly and rearwardly curving strip of spring steel whose lower free edge rides on the working surface of the cliche, thus wiping off excess ink prior to transferring ink from the cliche to the pad. The free edge is polished, and a downward force is applied whereby the strip is resiliently deformed by contact between the free edge and the working surface.

4 Claims, 3 Drawing Sheets

PAD TRANSFER PRINTING DOCTOR BLADE AND METHOD

BACKGROUND OF THE INVENTION

The invention relates to the art of pad transfer printing, and more particularly to an improved doctor blade for use in such printing.

In pad transfer printing generally, a cliche is used, the cliche having an image recessed in the normally planar working surface, typically in the form of a pattern of closely spaced discrete recesses. The working surface is flooded with a thixotropic ink, some of which flows into and fills the discrete recesses. A doctor blade then is passed over the working surface, Shearing the excess ink not in the recesses and removing it from the working surface. A resilient pad is then lowered into contact with the image, whereupon the ink in the recesses transfers to the pad. The pad is then pressed against the final destination target, such as a golf ball or coffee mug, resulting of a transferral of the image to the target.

Early processes of this general type used a cliche made of stainless steel having the image etched or otherwise formed in the working surface. Such processes were generally satisfactory from the standpoint of service life of the cliche, but the cost 0f making the cliche were substantial.

Note recently, much less expensive cliches have become available. These more recent cliches are in the form of certain photopolymer films which are somewhat soluble in water. If a portion of such a film is exposed to ultraviolet radiation, that portion becomes less soluble in water. Accordingly, an opaque image placed on the upper or working surface of the film protects the polymer in the regions under the image from the radiation, leaving it soluble. A subsequent water bath then removes the polymer which had been protected by the image, leaving a recessed copy of the image ready to receive the ink. The opposite or lower surface of the film is typically affixed by an adhesive to a supporting substrate. Typical commercially available polymer films of this type are "PRINTIGHT" from Toyobo and "LSL-295-B" from TOK. Cliches made by such processes are far less expensive than the stainless steel cliches.

The known prior art practice is to use various types of rigid doctor blades with these photopolymer cliches, as was common with the stainless steel cliches.

Unfortunately, this results in short service lives for the cliches, which become damaged after perhaps 1–2000 cycles of use, with a certain percentage of premature failure.

These and other problems with the prior art practices are avoided by the present invention, which provides an improved doctor blade permitting substantially improved service life for the cliches with a lower percentage of premature failures.

SUMMARY OF THE INVENTION

According to a primary aspect of the invention, there is provided a doctor blade assembly for use in a pad transfer printing process wherein thixotropic ink is flooded across the working surface of a cliche and excess ink is removed by the assembly, the assembly comprising support means for supporting a doctor blade having a free edge for movement in a given direction along the working surface. The doctor blade comprises a downwardly and rearwardly curving strip of spring metal terminating in a terminal section in the immediate vicinity of the working surface, the terminal section having a width transverse to the given direction at least as wide as the working surface, given height, a relatively small thickness in the given direction, and a front surface terminating in the free edge. The free edge is parallel to and in contact with the working surface, and the front surface forms an obtuse trailing angle with the working surface. Means are provided for applying a downward force to the support means, whereby the strip of spring metal is resiliently deformed by contact between the free edge and the working surface.

According to another aspect of the invention, the free edge is polished. According to another aspect of the invention, the obtuse trailing angle is between 120 and 170 degrees.

According to another aspect of the invention, the spring metal is spring steel.

According to another aspect of the invention, the downward force is selected to be sufficiently large to shear and remove the excess ink and sufficiently small to minimize damage to the working surface.

Other aspects will in part appear hereinafter and will in part be apparent from the following detailed description taken together with the accompanying drawings.

DESCRIPTION OF THE PREFERRED EMBODIMENT

Figure 1:
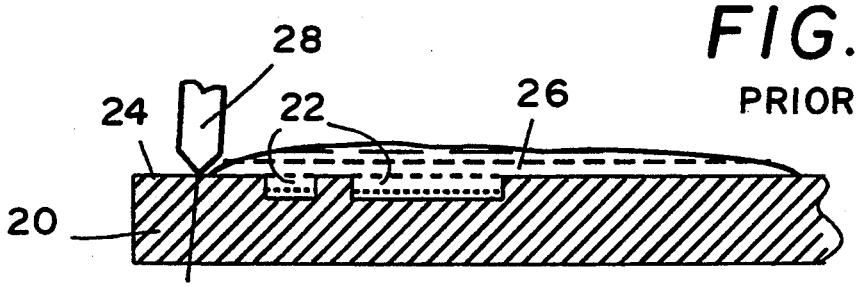
FIG. 1 PRIOR ART
FIG. 1 is a vertical elevational view, partly in section, of a portion of a prior art stainless steel cliche, the working surface having been flooded with ink, just prior to operation of the doctor blade.
Figure 2:
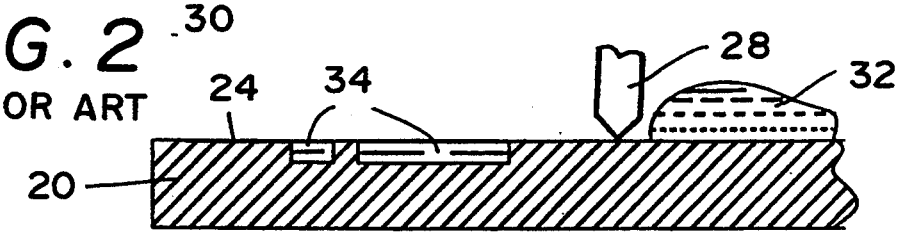
FIG. 2 PRIOR ART
FIG. 2 is a view similar to FIG. 1, wherein the doctor blade has cleared excess ink from most of the working surface, leaving ink in the image recesses.

With reference to FIG. 1, stainless steel cliche 20 has recesses 22 in upper working surface 24, recesses 22 being a portion of an image to be printed. Ink layer 26 has flooded working surface 24, filling recesses 22. Doctor blade 28 is ready to be moved to the right as viewed in FIG. 1 with its lower edge 30 in contact with working surface 24, thus scraping away the excess ink 32 while leaving ink 34 filling recesses 22, as illustrated in FIG. 2.

Figure 3:
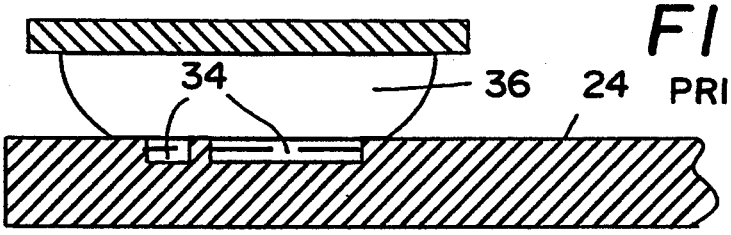
FIG. 3 PRIOR ART
FIG. 3 is an elevation view, partly in section, of the transfer pad contacting the image on the working surface, preparatory to collecting the ink in the recesses.
Figure 4:
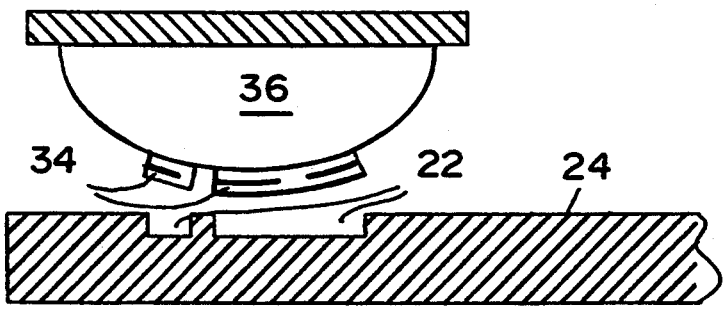
FIG. 4 PRIOR ART
FIG. 4 is a view similar to FIG. 3, with the pad being withdrawn with the ink formerly held in the recesses.

FIG. 3 shows transfer pad 36 being pressed onto working surface 24 in order to pick up ink 34, while FIG. 4 shows transfer pad 36 being raised above working surface 24, ready to transfer the image to a target substrate.

Figure 5:
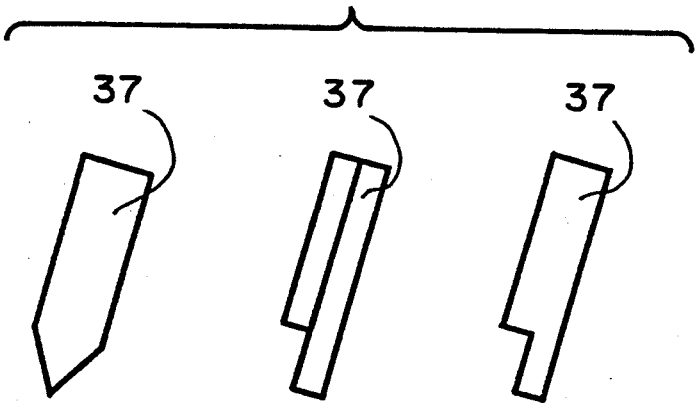
FIG. 5 PRIOR ART
FIG. 5 is a side elevational view of three different types of known prior art doctor blades, each of which is essentially rigid in operation.

FIG. 5 illustrates various prior art doctor blades 37. Such doctor blades provide a relatively short cliche service life as noted above.

Figure 6:
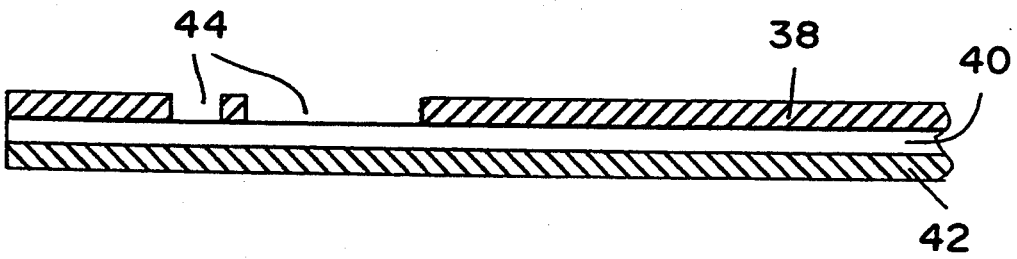
FIG. 6 is a schematic side elevational view, partly broken away, of the photopolymer type of cliche.

FIG. 6 schematically illustrates the modern photopolymer cliche film 38 affixed by adhesive layer 40 to supporting substrate 42. As with the prior art cliche 20 of FIG. 1, an image in the form of discrete recesses 44 is formed in the upper or working surface 46 of cliche 38. Working surface 46 is then flooded with ink, analogously to that illustrated in FIG. 1, with ink flowing into recesses 44 and excess ink remaining on working surface 46.

Figure 7:
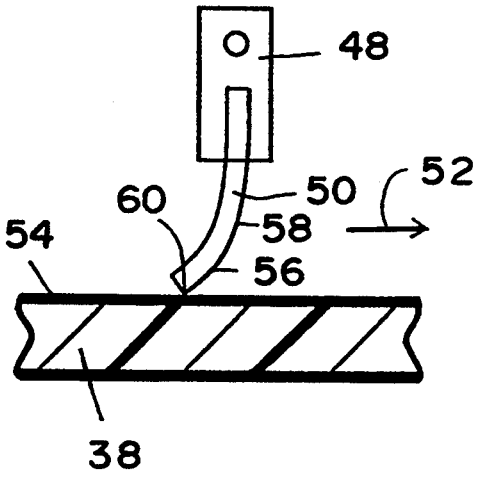
FIG. 7 is a schematic side elevation of the doctor blade of the present invention in contact with the working surface of a cliche.

FIG. 7 schematically illustrates the improved doctor blade of the present invention. As shown therein, support means 48 supports doctor blade 50 for movement in a given direction indicated by arrow 52 along working surface 54 of cliche 38. Doctor blade 50 comprises a downwardly and rearwardly curving strip of spring steel terminating in a terminal section 56 in the immediate vicinity of working surface 54. Terminal section 56 has a width (perpendicular to the plane of the drawing) at least as wide as working surface 54 of cliche 38, a given height above working surface 54, and a relatively small thickness in the direction indicated by arrow 52.

Terminal section 56 has a front surface 58 terminating in free edge 60, which free edge is parallel to and in contact with working surface 54. Front surface 58 forms an obtuse trailing angle with working surface 54 as indicated by arc 62, the obtuse trailing angle being preferably between 120 and 170 degrees.

Means are provided for applying a downward force to support means 48, whereby the strip of spring metal (preferably spring steel) of which doctor blade 50 is made is resiliently deformed by contact between free edge 60 and working surface 54. The downward force is preferably selected to be sufficiently large to shear and remove the excess ink and sufficiently small to minimize damage to working surface 54.

Free edge 60 is preferably polished, as by being successively ground, honed and stropped with a material such as jeweler's rouge. Excellent results have been obtained using a strip of spring steel approximately 0.005 inch (0.127 mm) thick.

Doctor blades according to the invention produce a service life for the cliche substantially greater than prior art doctor blades, typically twice the service life or more, with less cases of premature failure.

The term "working surface" as used herein means the portion of the upper surface of the cliche containing the image to be transferred. Ordinarily the doctor blade contacts the entire upper surface, and provides better service life if it does so, but a smaller area could be wiped if desired.

I claim:

1. A pad transfer printing method, comprising the steps of:

providing a polymeric film cliche having a normally planar work surface, said work surface having an image therein defined by at least one recess in said normally planar work surface;

flooding said work surface with printing ink whereby said at least one recess is filled with said ink;

providing a doctor blade comprising a downwardly and rearwardly curving strip of spring metal;

passing said doctor blade over said normally planar work surface in a given direction of movement whereby a front surface of said doctor blade faces said direction of movement and said doctor blade is resiliently deformed during movement of same along said work surface along said direction of movement, said doctor blade removing ink from said work surface during said movement while leaving said at least one recess filled with ink;

contacting said work surface with a resilient pad whereby ink in said at least one recess is transferred to said pad, thus transferring said image to said pad; and, contacting said pad having said transferred image to a surface to which said image is to be transferred.

2. The method of claim 1 wherein said polymeric film is a photopolymeric film.

3. The method of claim 1 wherein said doctor blade is comprised of spring steel.

4. The method of claim 1 wherein the width of said doctor blade is at least as wide as the width of said work surface.

* * * * *